US011673360B2

(12) United States Patent
Chase et al.

(10) Patent No.: US 11,673,360 B2
(45) Date of Patent: Jun. 13, 2023

(54) ADAPTABLE HYDRAULIC PRESS

(71) Applicant: ACMT, Inc., Manchester, CT (US)

(72) Inventors: Carter Chase, Haddam Neck, CT (US); William Hohorst, Medford, MA (US); Anthony Marino, Haddam, CT (US)

(73) Assignee: ACMT, Inc., Manchester, CT (US)

( * ) Notice: Subject to any disclaimer, the term of this patent is extended or adjusted under 35 U.S.C. 154(b) by 242 days.

(21) Appl. No.: 16/863,486

(22) Filed: Apr. 30, 2020

(65) Prior Publication Data

US 2020/0391468 A1 Dec. 17, 2020

Related U.S. Application Data

(60) Provisional application No. 62/841,440, filed on May 1, 2019.

(51) Int. Cl.
*B30B 15/04* (2006.01)
*B30B 15/22* (2006.01)

(52) U.S. Cl.
CPC ..... *B30B 15/045* (2013.01); *B30B 15/041* (2013.01); *B30B 15/22* (2013.01)

(58) Field of Classification Search
CPC ..... B30B 15/22; B30B 15/045; B30B 15/041; B21D 37/10
USPC ..... 72/352, 455; 264/319
See application file for complete search history.

(56) References Cited

U.S. PATENT DOCUMENTS 1,958,199 A * 5/1934 Morin ..... B22D 17/12 425/352
3,848,494 A * 11/1974 Gargrave ..... B21D 37/14 83/563
4,419,878 A * 12/1983 Fusser ..... B30B 15/042 72/453.01
2013/0320593 A1* 12/2013 Solty ..... B30B 15/028 264/319

FOREIGN PATENT DOCUMENTS

DE 3802266 * 8/1989
DE 202016005 * 11/2016

* cited by examiner

*Primary Examiner* — Shelley M Self
*Assistant Examiner* — Smith Oberto Bapthelus
(74) *Attorney, Agent, or Firm* — Dilworth IP, LLC

(57) ABSTRACT

A hydraulic press includes a press assembly moveable in relation to a support assembly by actuation of an actuator to provide a compressive force between the top platen and the bottom platen. The press assembly includes a top platen, a counter balance, and at least one platen guide rod interconnected between the top platen and the counter balance. The support assembly includes a bottom platen, a base frame, and at least one counter balance guide rod interconnected between the bottom platen and the base frame. The actuator is mounted between the bottom plate and the counter balance. The actuator is interchangeable with another actuator to change the compressive force of the hydraulic press.

20 Claims, 7 Drawing Sheets

ADAPTABLE HYDRAULIC PRESS

CROSS REFERENCE TO RELATED APPLICATION

This application claims the benefit of U.S. Provisional Patent Application No. 62/841,440, filed on May 1, 2019, the contents of which are incorporated herein by reference in their entirety.

TECHNICAL FIELD

The present invention relates generally to hydraulic presses and, more particularly, to adaptable hydraulic presses.

BACKGROUND OF THE INVENTION

The majority of hydraulic presses for use in manufacturing or forming parts are relatively large in design and require a comparatively large force to be applied to the press to make or form a part. There is a need for an adaptable or scalable force hydraulic press that provides accurate, repeatable and adjustable force upon closure of the press, and that produces a high-quality part in a compact, efficient and affordable manner.

SUMMARY

In one aspect, the present invention is directed to an adaptable frame for a hydraulic press. The adaptable frame includes a press assembly and a support assembly moveable in relation to each other. The press assembly includes a top platen, a counter balance, and at least one platen guide rod interconnected between the top platen and the counter balance. The support assembly includes a bottom platen, a base frame, and at least one counter balance guide rod interconnected between the bottom platen and the base frame. The press assembly is moveable in relation to the support assembly by actuation of the actuator to provide a compressive force between the top platen and the bottom platen. At least one of the top platen and counter balance is interchangeable with another respective top platen and counter balance to change the mass of the press assembly to change the compressive force.

In another aspect, the present invention is directed to a hydraulic press including a press assembly and a support assembly moveable in relation to each other by actuation of an actuator. The press assembly press assembly includes a top platen, a counter balance, and at least one platen guide rod interconnected between the top platen and the counter balance. The support assembly includes a bottom platen, a base frame, and at least one counter balance guide rod interconnected between the bottom platen and the base frame. The actuator is mounted between the bottom plate and the counter balance. The press assembly is moveable in relation to the support assembly by actuation of the actuator to provide a compressive force between the top platen and the bottom platen. The actuator is interchangeable with another actuator to change the compressive force of the hydraulic press.

In another aspect, the present invention is directed to an adaptable frame for a hydraulic press. The adaptable frame includes a press assembly and a support assembly moveable in relation to each other. The press assembly includes a top platen, a counter balance, and at least one platen guide rod interconnected between the top platen and the counter balance. The support assembly includes a bottom platen, a base frame, and at least one counter balance guide rod interconnected between the bottom platen and the base frame. The press assembly is moveable in relation to the support assembly by actuation of the actuator to provide a compressive force between the top platen and the bottom platen. At least one of the at least one of the platen guide rod and the at least one of the counter balance guide rod is interchangeable with another respective at least one platen guide rod and at least one counter balance guide rod having a different length to provide a different spacing between at least the top platen and bottom platen and/or a different spacing between the counter balance and the bottom platen.

DETAILED DESCRIPTION

Figure 1:
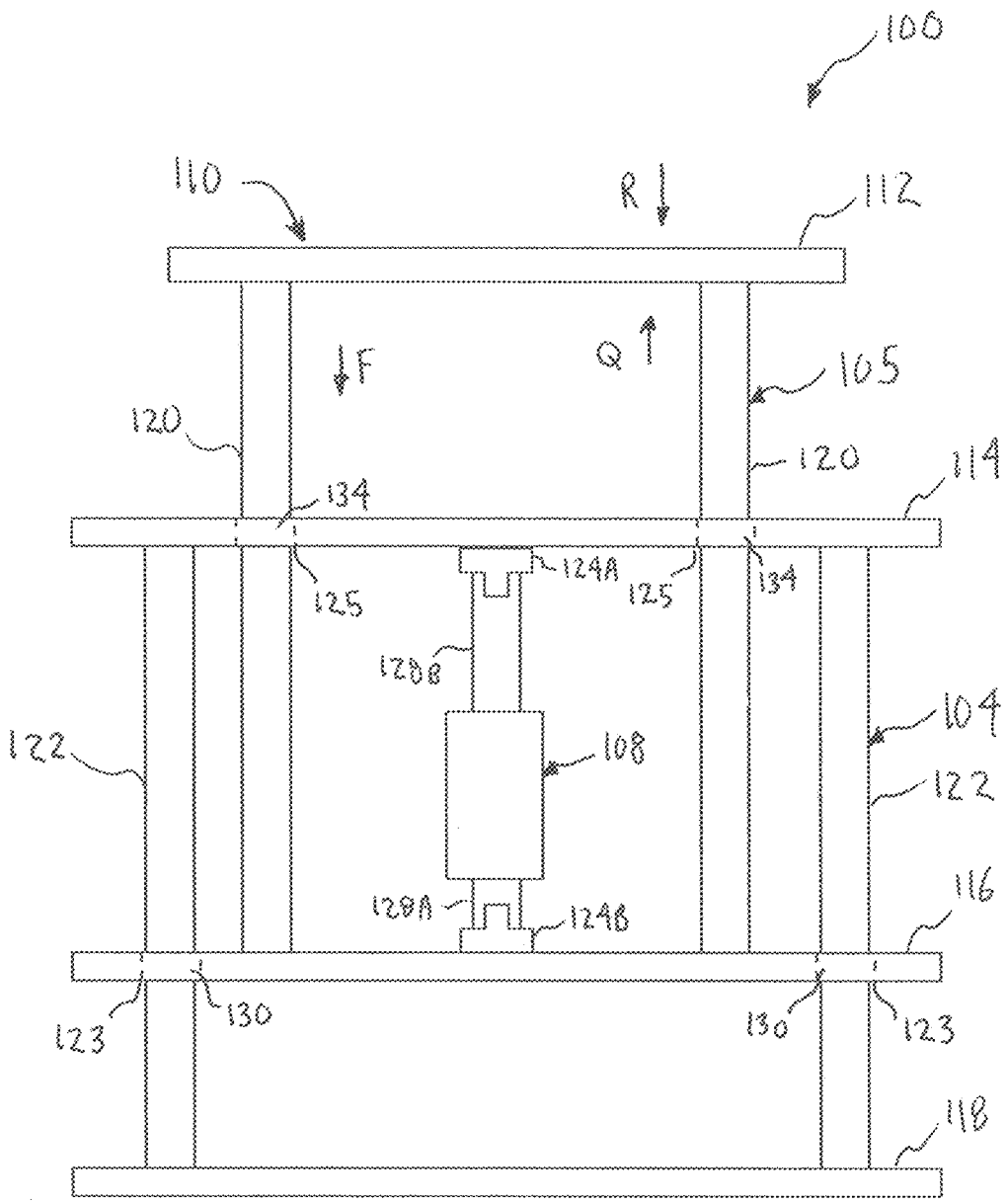
FIG. 1 illustrates a side view of a hydraulic press in accordance with an embodiment of the present invention.
Figure 3A:
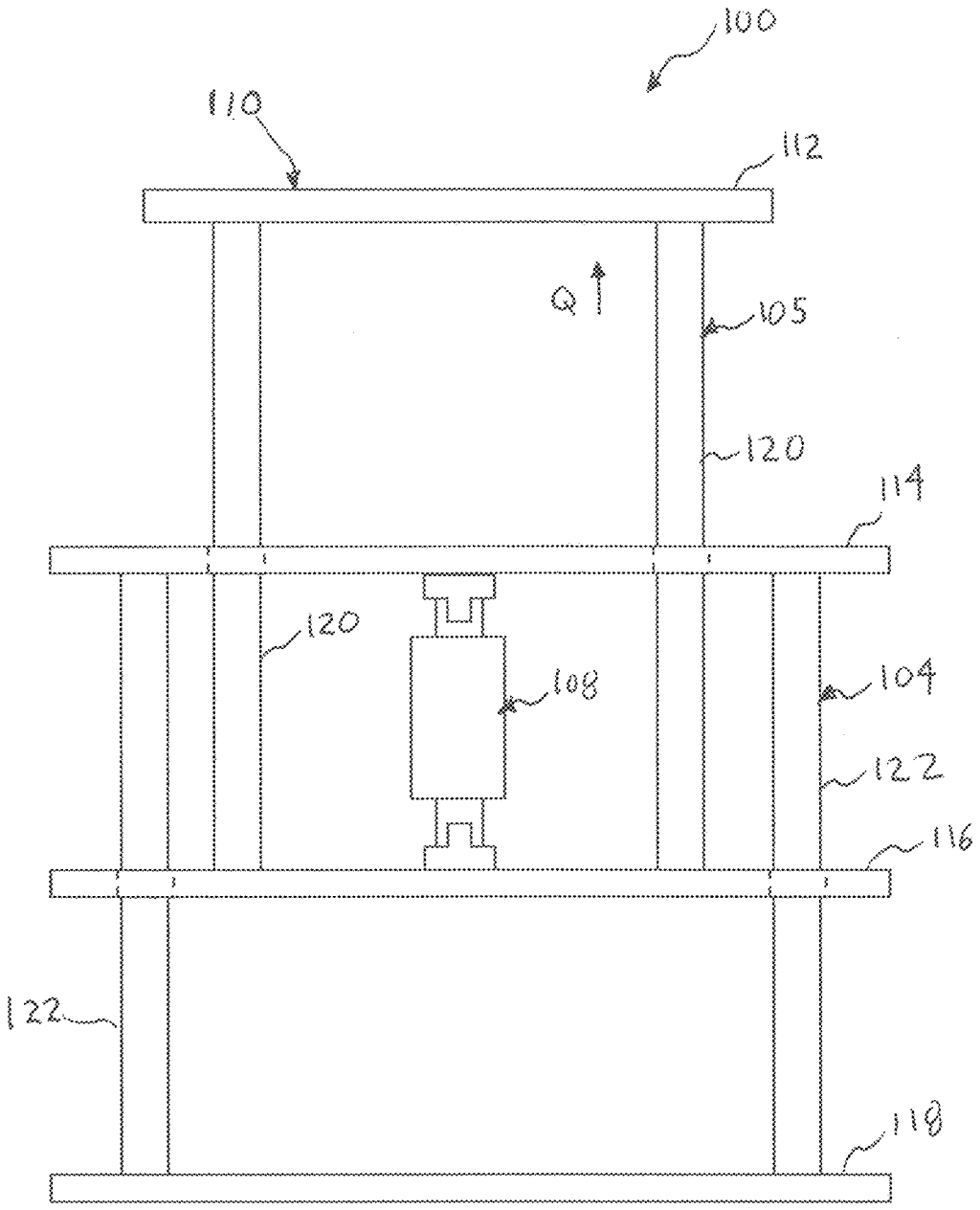
FIG. 3A illustrates a side view of the hydraulic press of FIG. 1 in an open position.
Figure 3B:
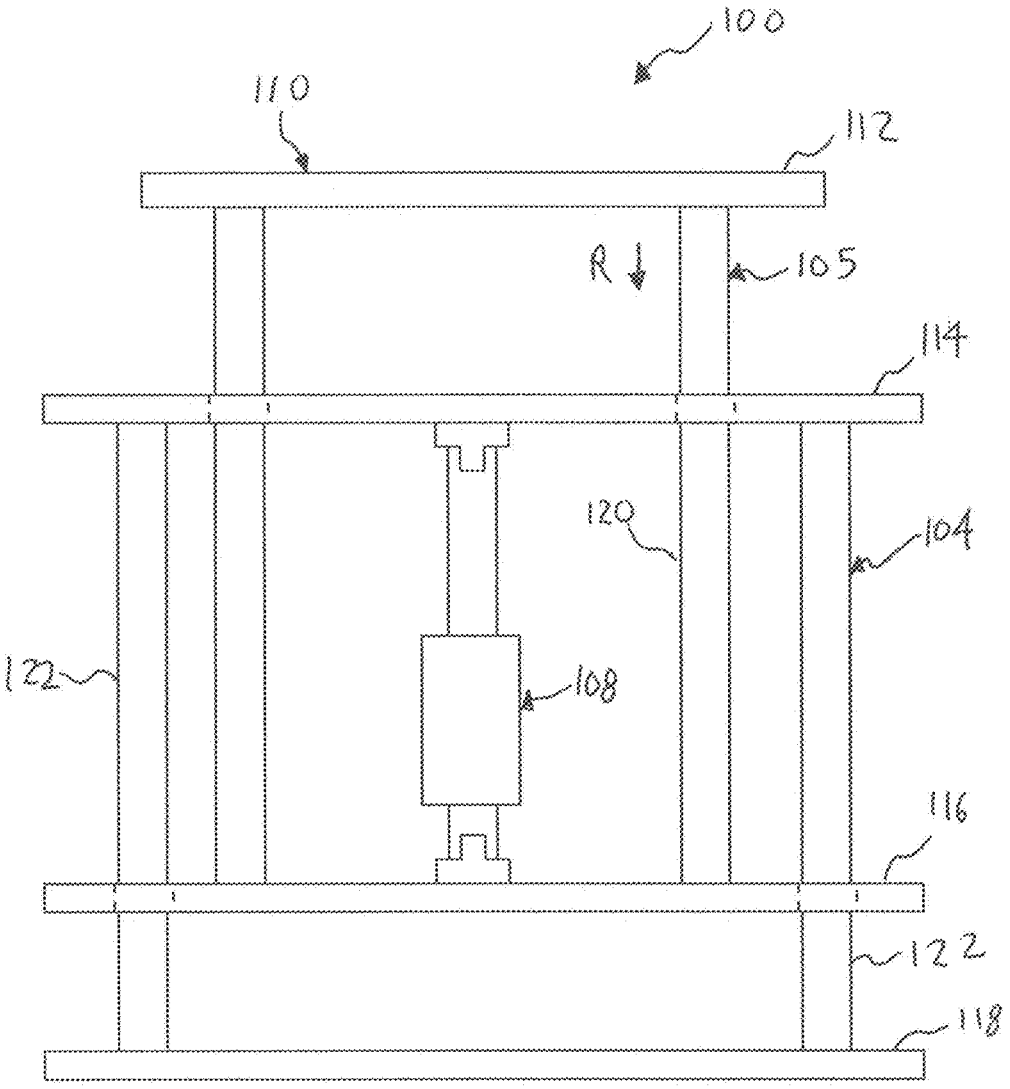
FIG. 3B illustrates a side view of the hydraulic press of FIG. 1 in a retracted/compressed position.
Figure 4:
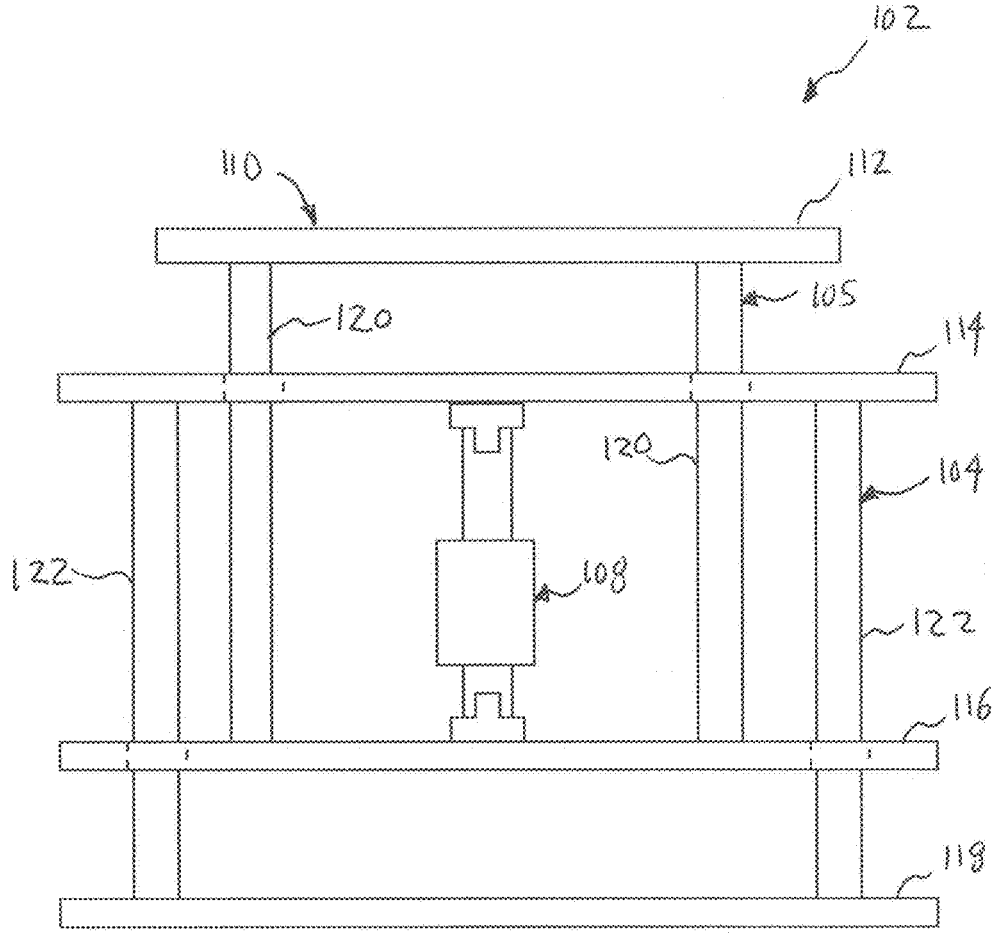
FIG. 4 illustrates a side view of the frame of FIG. 1 adapted to first configuration.
Figure 5:
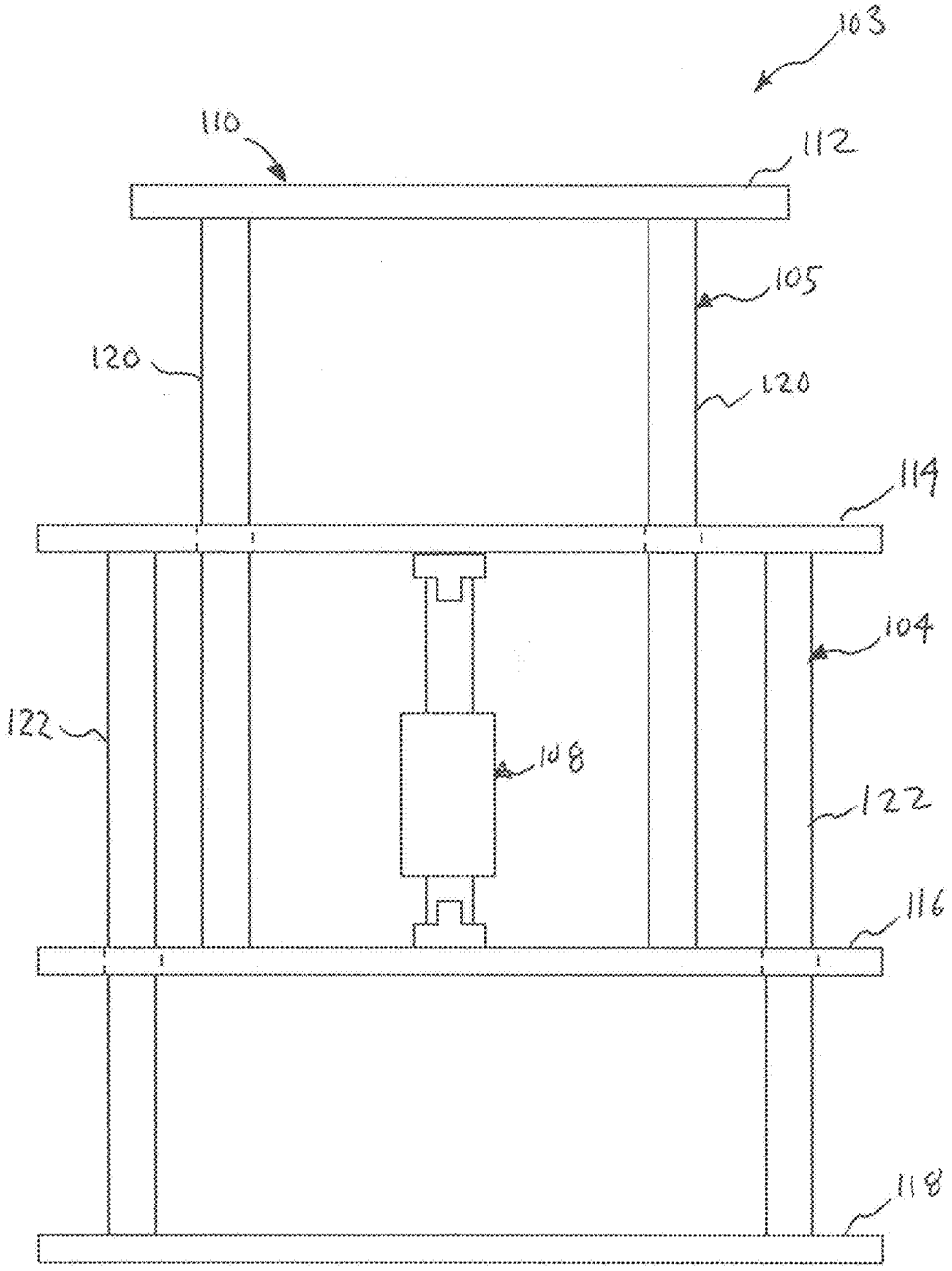
FIG. 5 illustrates a side view of the frame of FIG. 1 adapted to a second configuration.

As shown in FIGS. 1, 4 and 5, various configurations of a hydraulic press 100, 102, 103, such as a hydraulic counter balance drop press, in accordance with the present invention include an adaptable frame 110 having includes a support assembly 104 and a press assembly 105 that is movable in relation to the support assembly 104. One or more actuators or hydraulic cylinders 108 are releasably mounted between the support assembly 104 and the press assembly 105. The one or more actuators or hydraulic cylinders 108 raise and lower the press assembly 105 in relation to the support assembly 104, as best shown in FIGS. 3A and 3B.

The press assembly 105 includes a top platen 112 and a counter balance 116 (e.g., a plate) interconnected by a plurality of platen guide rods 120. The support assembly 104 includes a bottom platen 114 and a frame base 118 interconnected by a plurality of counter balance rods 122. The support assembly 104 and the press assembly 105 are movably interconnected to enable the press assembly 105 to move up and down in relation to the support assembly 104. Specifically, the counter balance rods 122 pass through respective through-bores 123 located in the counter balance 116. Similarly, the platen guide rods 120 pass through respective through-bores 125 located in the bottom platen 114. The ends of guide rods 120, 122 may be removably attached, such as by a bolt, screw or other fastener, to the corresponding top platen 112, bottom platen 114, counter balance 116 and frame base 118, respectively.

The adaptable frame 110 further includes one or more hydraulic cylinder mounts 124A coupled to the bottom platen 114 and one or more hydraulic cylinder mounts 124B coupled to the counter balance 116. An actuator or hydraulic cylinder 108 is mounted between each pair of the hydraulic cylinder mounts 124A and 124B. For example, one end or a base 128A of hydraulic cylinder 108 is affixed to counter balance 116 at mount 124B, and a shaft or piston 128B of hydraulic cylinder 108 is affixed to bottom platen 114 at mount 124A.

Figure 2:
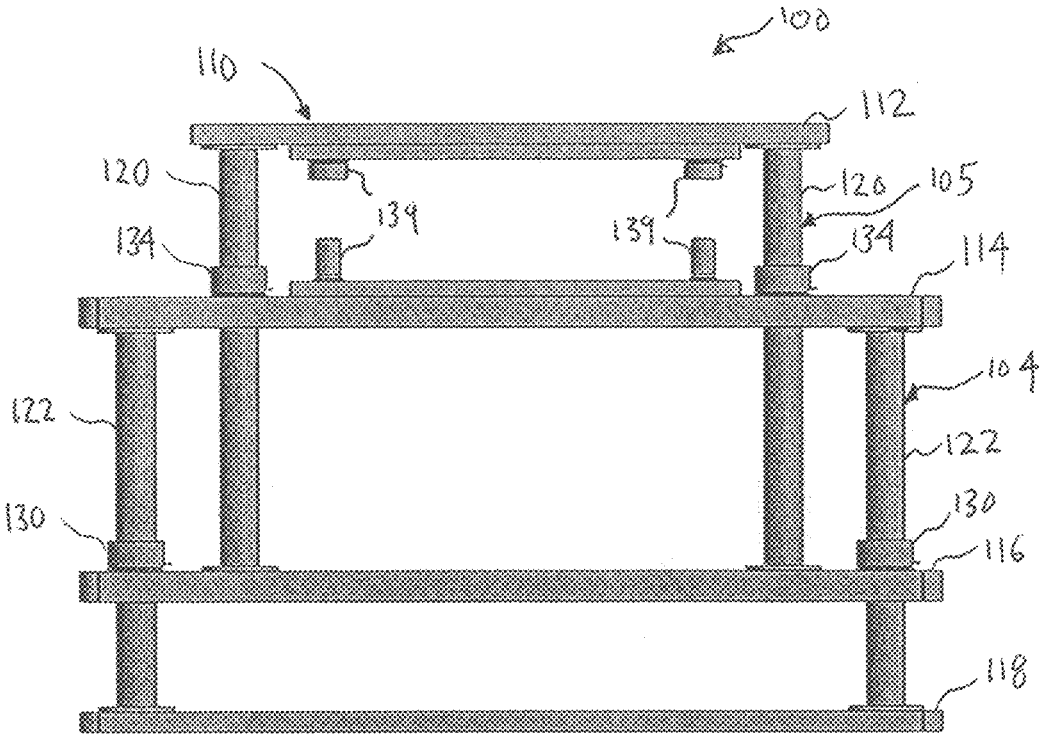
FIG. 2 is a side view of a frame of a hydraulic press in accordance with another embodiment of the present invention.

As shown in FIG. 1, the counter balance guide rods 122 may guide the counter balance 116 through the use of bearings 130, such as for example rolling bearings, disposed within the through-bores 123 of the counter balance 116 and selected or adapted to receive the respective counter balance guide rod 122 therethrough. Similarly, the platen guide rods 120 move correspondingly with the counter balance guide rods 122 through the use of bearings 134, such as for example rolling bearings, disposed within the through-bores 125 of the bottom platen 114 and selected or adapted to receive the respective platen balance guide rod 120 therethrough. Alternatively, as shown in FIG. 2, the bearings 130 may be proximate the counter balance 116; and the bearings 134 may be proximate the bottom platen 114. As further shown in FIG. 2, a dye set 139 may be releasably attached to the lower surface of the top platen 112 and the upper surface of the bottom platen 114 sufficiently spaced to receive material of a part when the hydraulic press 101 is in an open position. In operation, the actuation of the hydraulic cylinder 108 to lower the top platen 112 in combination with the mass of the top platen 112 and the counter balance 116 provides a compressive force F to sufficient to compress the dye set 139 together to form the desired part from the material disposed therebetween.

The counter balance rods 122 and the platen guide rods 120 described hereinabove maintain the position of the counter balance 116 in relation to the top platen 112 and the bottom platen 114. In operation, the counter balance 116 may be and remain substantially parallel to the top platen 112 such that the compressive force F is applied evenly or uniformly across the bottom platen 114 when the top platen 112 is lowered to compress a part to be manufactured between the top platen 112 and the bottom platen 114.

As shown in FIGS. 3A and 3B, in operation, the adaptable frame 110 of the hydraulic counter balance drop press 100 of FIG. 1 is operable between an open position (as shown in FIG. 3A) and a retracted/compressed position (as shown in FIG. 3B). The press assembly 105 is moved into an open position, as shown in FIG. 3A, when the hydraulic cylinder 108 is moved into a retracted position and this action results in moving the press assembly 105 in an upwardly direction indicated by the arrows Q. Such actuation of the hydraulic cylinder 108 results in movement to raise the top platen 112 together with the counter balance 116. The adaptable frame 110 is moved into a retracted/compressed position, as shown in FIG. 3B, when the hydraulic cylinder 108 is moved into an extended position and this action results in moving the press assembly 105 in a downwardly direction indicated by the arrows R to apply the aforementioned compressive force F to form a part. Such actuation of the hydraulic cylinder 108 results in movement to lower the top platen 112 together with the counter balance 116.

The adaptable frame 110 of the drop press 100 is selectively customizable to accommodate the making or forming of parts of various sizes and materials compressed between the top platen 112 and the bottom platen 114. The dimensions of the adaptable frame 110 may be modified by selectively changing the lengths of platen guide rods 120 and/or counter balance guide rods 122 by replacing the rods 120, 122 with different lengths or changing the lengths of telescoping rods, for example. For instance, referring to FIG. 4, the adaptable frame 110 of FIG. 1 may be selectively customizable to a first configuration having shorter platen guide rods 120 and shorter counter balance guide rods 122, to provide a small hydraulic press 100 to manufacture smaller parts requiring less compressive force to manufacture. Referring to FIG. 5, the adaptable frame 110 of FIG. 1 may be selectively customizable to a second configuration having longer platen guide rods 120 and longer counter balance guide rods 122 to manufacture larger parts requiring more compressive force to manufacture. The spacing between the top platen 112 and the bottom platen 114 limit the part size to be manufactured, while the spacing between the bottom platen 114 and the counter balance 116 limits the size of the actuator and thus the compressive force of the hydraulic press. The present invention also contemplates the platen guide rods 120 and the counter balance guide rods 122 may be independently changed to accommodate the desired frame configuration for the part to be manufactured. For example, the platen guide rods 120 may be shortened, while the counter balance guide rods 122 remain the same length, and vice versa.

Referring to FIG. 1, the two components, namely the top platen 112 together with the counter balance 116, are configured or selected to apply a compressive force F to the bottom platen 114 based at least partially on a total mass of the top platen 112 and the counter balance 116 when moving into the retracted/compressed position. For example, the compressive force F applied to the bottom platen 114 is increased by increasing the total mass of the top platen 112 and the counter balance 116. Similarly, the force F applied to the bottom platen 114 is decreased by decreasing the total mass of the top platen 112 and the counter balance 116. Thus, the force F applied to the bottom platen 114 to make or form a part, which is disposed between the upper platen 112 and the lower platen 114, is scalable (e.g., selectively increasable and decreasable) to accommodate a range of forces that may be selected as the desired force F. This scalability may be achieved by modifying the adaptable frame 110 by substituting the top platen 112 and/or the counter balance 116 with a different top platen or counter balance having a different mass. In one embodiment, the range of forces that may be selected as the desired force F is from about 10 kilonewtons (kN) (about 1 short ton-force (short tf)) to about 500 kN (about 56 short tf). In one embodiment, the range of forces that may be selected as the desired force F is from about 45 kN (about 5 short tf) to about 175 kN (about 20 short tf).

In one embodiment, the counter balance guide rods 122 may be fixedly attached between the frame base 118 and the bottom platen 114. In another embodiment, the platen guide rods 120 are fixedly attached between the counter balance 116 and the top platen 112. In yet another embodiment, the counter balance guide rods 122 are fixedly attached between the frame base 118 and the bottom platen 114; and the platen guide rods 120 are fixedly attached between the counter balance 116 and the top platen 112.

In one embodiment, the hydraulic cylinder mounts 124A and 124B include standard fork mounts to accommodate interchangeability of hydraulic cylinders 126. In operation, the hydraulic cylinder 126 is selected to accommodate or supplement the application of the compressive force F to the bottom platen 114. For example, the force applied by the hydraulic cylinder 126 is dependent on bore size and shaft of the selected hydraulic cylinder. Thus, the selection of a particularly-sized hydraulic cylinder 126 accommodates or supplements the application of the compressive force F applied to the bottom platen 114 when moving into the retracted/compressed position.

Figure 6:
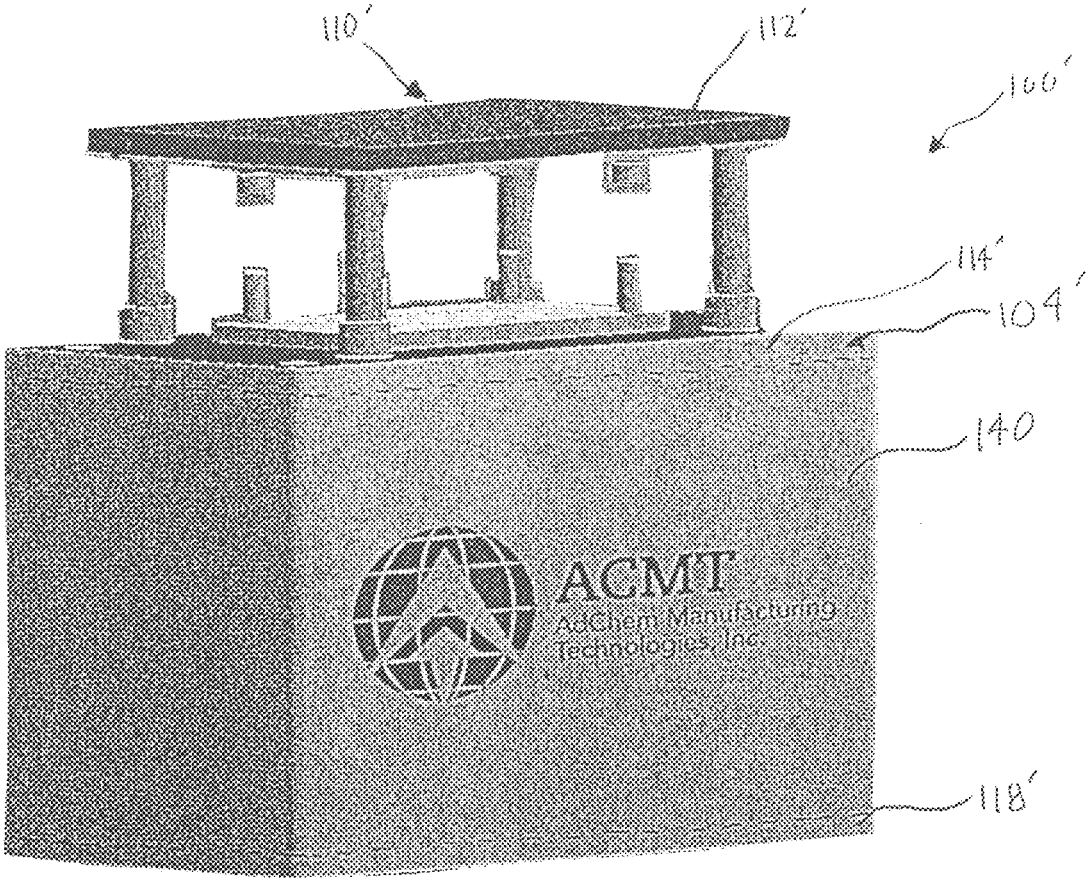
FIG. 6 is a front perspective view a hydraulic press in accordance with an embodiment of the present invention.

In one embodiment, as shown in FIG. 6, an adaptable frame 110' of a hydraulic press 100' includes a housing 140 that provides a safety enclosure around all four sides of a support assembly 104' that extends upwardly from the frame base 118' to a bottom platen 114'. In one embodiment, the adaptable frame 110' includes a light curtain field and/or safety glass (not shown) that extends upwardly from the bottom platen 114' to a top platen 112'.

In one embodiment, the adaptable frame 110 of the hydraulic counter balance drop press 100 includes a programmable logic controller (PLC) to control the hydraulic cylinder 108 and the actuation thereof to regulate the movement of the press assembly 105 in relation to the support assembly 104.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above-detailed description, but that the invention will include all embodiments falling within the scope of the appended claims.

A list of reference numerals included in the above disclosure follows:

100—a hydraulic counter balance drop press;
104—a support assembly;
105—a press assembly;
108—a hydraulic cylinder
110—an adaptable frame;
112—a top platen;
114—a bottom platen;
116—a counter balance;
118—a frame base;
120—platen guide rods;
122—counter balance guide rods;
123—through-bore
124A and 124B—hydraulic cylinder mounts;
125—through-bore
128A—hydraulic cylinder base;
128B—hydraulic cylinder piston;
130—bearings;
134—bearings;
139—dye set; and
140—a housing.

What is claimed is:

1. An adaptable frame of a hydraulic press comprising:

a stationary support assembly comprising a bottom platen, a frame base disposed below the bottom platen, and at least one counter balance guide rod interconnected between the bottom platen and the frame base; and a press assembly slidably secured to the stationary assembly, the press assembly comprising a top platen, a counter balance disposed below the top platen, and at least one platen guide rod interconnected between the top platen and the counter balance, wherein a bottom surface of the top platen opposes a top surface of the bottom platen;

wherein the press assembly is moveable in relation to the stationary support assembly by actuation of an actuator disposed between the bottom platen and the counter balance to provide a compressive force to material disposed between the bottom surface of the top platen and the top surface of the bottom platen; and wherein at least one of the top platen and the counter balance is interchangeable with another respective top platen and counter balance having a different respective mass to change the mass of the press assembly to change the compressive force.

2. The adaptable frame of claim 1, wherein the counter balance includes at least one through-bore configured to receive the at least one counter balance guide rod; and the bottom platen includes at least one through-bore configured to receive the at least one platen guide rod.

3. The adaptable frame of claim 1, further comprising:

at least one first mount coupled to a bottom surface of the bottom platen; and at least one second mount coupled a top surface of the counter balance;

wherein the at least one first mount and the at least one second mount are configured to interchangeably mount the actuator and another actuator.

4. The adaptable frame of claim 1, further comprising:

at least one first bearing disposed within or proximate the counter balance; and at least one second bearing disposed within or proximate the bottom platen;

wherein the at least one first bearing accommodates movement of the at least one counter balance guide rod therethrough; and wherein the at least one second bearing accommodates movement of the at least one platen guide rod therethrough.

5. The adaptable frame of claim 1, wherein at least one platen guide rod is removably interconnected between the top platen and the counter balance to enable replacement of the at least one platen guide rod with another at least one platen guide rod having a different length.

6. The adaptable frame of claim 5, wherein at least one counter balance guide rod is removably interconnected between the bottom platen and the frame base to enable replacement of the at least one counter balance guide rod with another at least one counter balance guide rod having a different length.

7. The adaptable frame of claim 1, wherein at least one counter balance guide rod is removably interconnected between the bottom platen and the frame base to enable replacement of the at least one counter balance guide rod with another at least one counter balance guide rod having a different length.

8. The adaptable frame of claim 1, wherein at least one platen guide rod is removably interconnected between the top platen and the counter balance to enable replacement of the counter balance with another counter balance having a different mass.

9. The adaptable frame of claim 1, wherein at least one platen guide rod is removably interconnected between the top platen and the counter balance to enable replacement of the top platen with another top platen having a different mass.

10. A hydraulic press comprising:

a stationary support assembly comprising a bottom platen, a frame base disposed below the bottom platen, and at least one counter balance guide rod interconnected between the bottom platen and the frame base;

a press assembly slidably secured to the stationary assembly, the press assembly comprising a top platen, a counter balance disposed below the top platen, and at least one platen guide rod interconnected between the top platen and the counter balance, wherein a bottom surface of the top platen opposes a top surface of the bottom platen; and an actuator mounted between the bottom platen and the counter balance;

wherein the press assembly is moveable in relation to the stationary support assembly by actuation of the actuator to provide a compressive force to material disposed between the bottom surface of the top platen and the top surface of the bottom platen; and wherein the actuator is interchangeable with another actuator to change the compressive force of the hydraulic press.

11. The hydraulic press of claim 10, wherein the counter balance includes at least one through-bore configured to receive the at least one counter balance guide rod; and the bottom platen includes at least one through-bore configured to receive the at least one platen guide rod.

12. The hydraulic press of claim 11, wherein at least one platen guide rod is removably interconnected between the top platen and the counter balance to enable replacement of the top platen with another top platen having a different mass.

13. The hydraulic press of claim 11, wherein at least one of the top platen and counter balance is interchangeable with another respective top platen and counter balance to change the mass of the press assembly to change the compressive force.

14. The hydraulic press of claim 10, further comprising:

at least one first mount coupled to a bottom surface of the bottom platen; and at least one second mount coupled a top surface of the counter balance;

wherein the actuator is interchangeably attached to the at least one first mount and the at least one second mount.

15. The hydraulic press of claim 10, further comprising:

at least one first bearing disposed within or proximate the counter balance; and at least one second bearing disposed within or proximate the bottom platen;

wherein the at least one first bearing accommodates movement of the at least one counter balance guide rod therethrough; and wherein the at least one second bearing accommodates movement of the at least one platen guide rod therethrough.

16. The hydraulic press of claim 10, wherein at least one platen guide rod is removably interconnected between the top platen and the counter balance to enable replacement of the at least one platen guide rod with another at least one platen guide rod having a different length.

17. The hydraulic press of claim 16, wherein at least one counter balance guide rod is removably interconnected between the bottom platen and the frame base to enable replacement of the at least one counter balance guide rod with another at least one counter balance guide rod having a different length.

18. The hydraulic press of claim 10, wherein at least one counter balance guide rod is removably interconnected between the bottom platen and the frame base to enable replacement of the at least one counter balance guide rod with another at least one counter balance guide rod having a different length.

19. The hydraulic press of claim 10, wherein at least one platen guide rod is removably interconnected between the top platen and the counter balance to enable replacement of the counter balance with another counter balance having a different mass.

20. An adaptable frame of a hydraulic press comprising:

a stationary support assembly comprising a bottom platen, a frame base disposed below the bottom platen, and at least one counter balance guide rod interconnected between the bottom platen and the frame base; and a press assembly slidably secured to the stationary assembly, the press assembly comprising a top platen, a counter balance disposed below the top platen, and at least one platen guide rod interconnected between the top platen and the counter balance, wherein a bottom surface of the top platen opposes a top surface of the bottom platen;

wherein the press assembly is moveable in relation to the stationary support assembly by actuation of an actuator disposed between the bottom platen and the counter balance to provide a compressive force to material disposed between the bottom surface of the top platen and the top surface of the bottom platen; and wherein at least one of the at least one of the platen guide rod and the at least one of the counter balance guide rod is interchangeable with another respective at least one platen guide rod and at least one counter balance guide rod having a different length to provide a different spacing between at least the top platen and bottom platen and/or a different spacing between the counter balance and the bottom platen.

* * * * *